United States Patent [19]

Pugsley

[11] 3,933,301

[45] Jan. 20, 1976

[54] CARTON STRUCTURE AND BLANK THEREFOR

[76] Inventor: Kenneth N. Pugsley, 2164 Wedgewood Road, Mississauga, Ontario, Canada

[22] Filed: Nov. 18, 1974

[21] Appl. No.: 524,925

[30] Foreign Application Priority Data

Nov. 19, 1973 Canada ..... 186201

[52] U.S. Cl. ..... 229/41 B

[51] Int. Cl.[2] ..... B65D 5/36

[58] Field of Search ..... 229/41 B, 41 R, 15, 41

[56] References Cited

UNITED STATES PATENTS

| | | | |
|---|---|---|---|
| 1,838,191 | 12/1931 | Rumpel | 229/41 B |
| 2,331,582 | 10/1943 | Trost | 229/41 B |
| 2,430,755 | 11/1947 | Bergstein | 229/41 B X |
| 2,593,773 | 4/1952 | Levkoff | 229/41 B |
| 2,703,198 | 3/1955 | Arnesom | 229/41 B |
| 3,039,670 | 6/1962 | Hardon | 229/41 B X |
| 3,135,453 | 6/1964 | Struble | 229/15 X |

*Primary Examiner*—Davis T. Moorhead

[57] ABSTRACT

A structure for producing a generally rectangular open-topped carton comprises a pair of opposite side panels having respective parallel bottom edges, a pair of opposite end panels having respective parallel bottom edges, the side and end panels forming a continuous wall, a base panel extending between and connected to the bottom edges of the side panels, each end panel being formed with an outwardly expressed medial fold line and the bottom panel being formed with an upwardly expressed medial fold line, the base panel and the end panels being folded about their respective medial fold lines so that the side panels lie superimposed on one another with the folded base panel between them, each end panel being formed with a pair of flap members hingedly connected to its bottom edge on opposite sides of the medial fold line, the carton being capable of being erected by application of pressure to opposite ends of said structure whereby the end panels, base panel and flap members are unfolded about their respective fold lines, the flap members being adapted to lie upon the upper surface of the base panel.

7 Claims, 6 Drawing Figures

CARTON STRUCTURE AND BLANK THEREFOR

This invention relates to cartons of the type which may be erected from a collapsed condition to an erect condition in which they may be used.

Canadian Pat. No. 793,678, issued on Sept. 3, 1968 to Kenneth J. Pugsley, relates to a carton of this general type, the carton being designed primarily for use in connection with check-out counters in supermarkets and being capable of erection, at a packaging station, from a collapsed storage condition to a usable condition by the simple application of pressure to the ends of the carton. The present invention relates to an improved carton of this type and is concerned primarily with the provision of a one-piece blank structure from which such a carton may be produced economically.

In order that the invention may be readily understood, one embodiment of the invention will now be described, by way of example, with reference to the accompanying drawings, in which.

Figure 1:
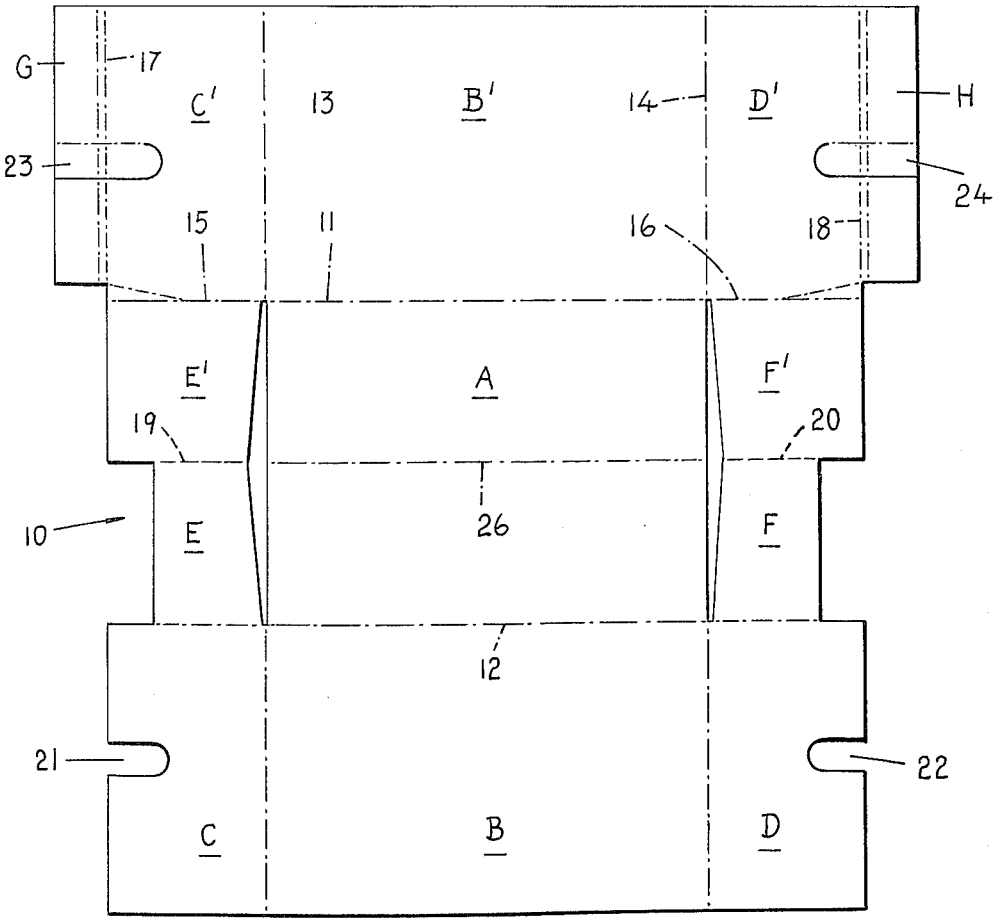
FIG. 1 illustrates a one-piece blank from which a carton structure according to the invention may be produced; j

Referring to FIG. 1, a one-piece blank from which a rectangular open-topped carton may be produced comprises a generally rectangular strip of sheet material 10 such as corrugated cardboard, the strip being formed with a pair of longitudinal fold lines 11, 12. Considering the face of the blank visible in FIG. 1 to be the top face, the fold lines are downwardly expressed. The fold lines 11, 12 define a rectangular plane A, which will be the base panel of the carton, and a pair of strip portions hingedly connected to the opposite longitudinal edges of the base panel. Each such strip portion is formed with downwardly expressed transverse fold lines 13, 14 aligned with the ends of the panel A, and downwardly expressed longitudinal fold lines 15, 16 aligned with the longitudinal edges of the panel, thus defining a side panel B (or B′) contiguous with the base panel, a pair of end panels C, D (or C′, D′) contiguous with the side panel, and a pair of flap members E, F (or E′, F′) contiguous with the end panels, the panels and flap members being hinged to one another about the respective fold lines. The end panels C′ D′ are provided with glue flaps G, H hingedly connected thereto by transverse fold lines 17, 18. The pairs of flap members E, E′ and F, F′ are connected together by brittle lines of weakness 19, 20 which readily break when the carton is finally erected so as to separate the flap members. It will be noted that the inner transverse edges of the flap members are cut on a slant so as to be slightly spaced from the ends of the panel A. The flap members E, F are somewhat shorter than the flap members E′, F′ so that their outer transverse edges will not interfere with one another when the carton is erected.

Figure 4:
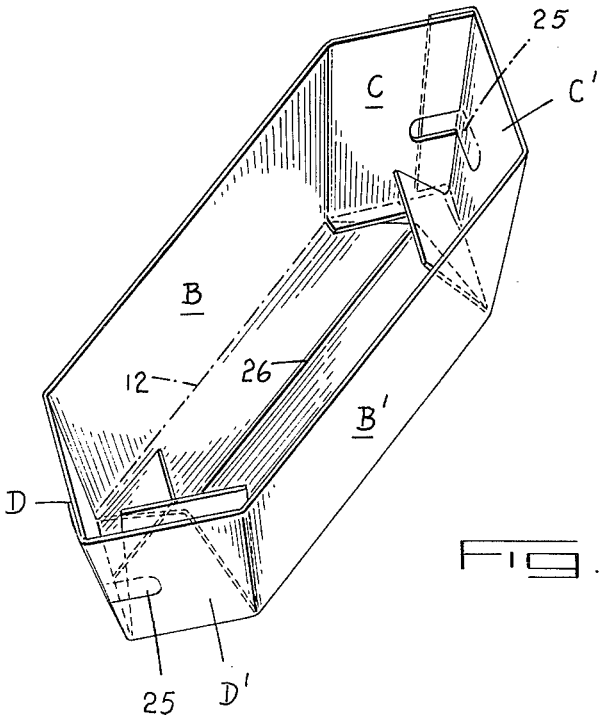
FIG. 4 is a perspective view of the carton in a stage between the collapsed condition and the erect condition.

As shown in FIG. 1, the end panels C, D, are formed with cut outs 21, 22, and the end panels C′, D′ are formed with correspondingly positioned areas 23, 24 which, when the carton is erected, can be pushed inwards to form handgrips, as indicated at 25 in FIG. 4.

The base panel A is formed with an upwardly expressed, medial fold line 26.

Figure 2:
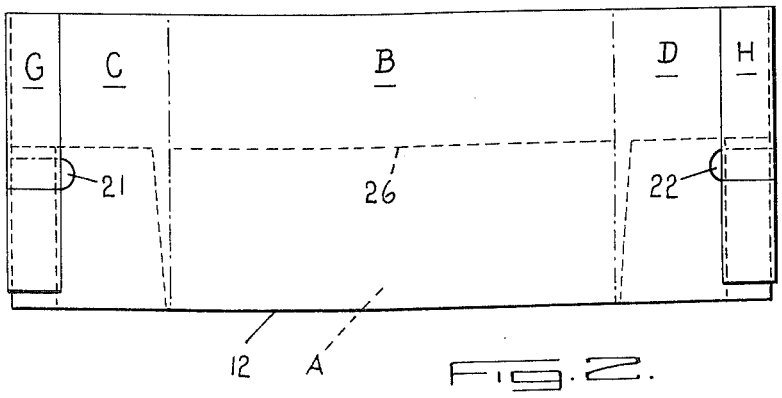
FIG. 2 illustrates the carton structure in the collapsed storage condition.
Figure 3:
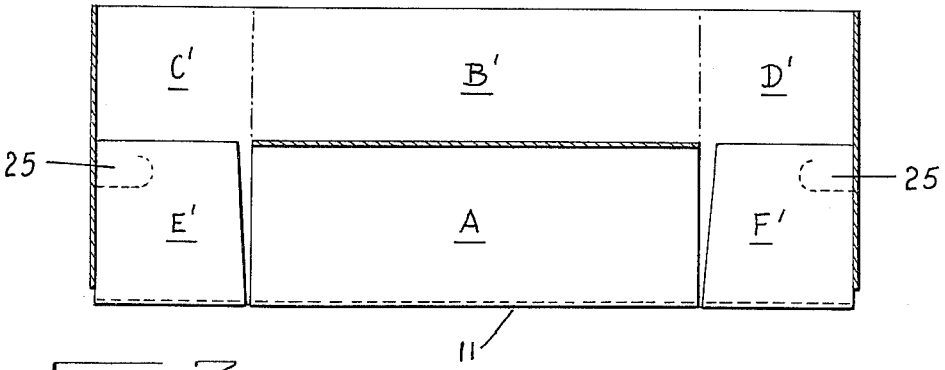
FIG. 3 is a sectional view in the longitudinal medial plane of the carton structure.

The blank 10 is formed into a flat structure of the form shown in FIGS. 2 and 3 by folding the blank about its longitudinal fold lines so that the side panels B, B′ lie superimposed on one another with the folded base panel A between them, and so that the pairs of end panels C, C′ and D, D′ lie superimposed with the pairs of connected flap members E, E′ and F, F′ between them. The glued flaps G, H are glued to the respective panels C, D thus forming at each end of the folded structure a composite end panel which is folded about a vertical medial fold line.

This structure is convenient to construct as it involves a minimum of glueing operations, and is economical since the blank from which it is formed can be die cut from a rectangular sheet with very little wastage of material. The resultant structure, illustrated in FIGS. 2 and 3 is easily stored in the flat condition and can be formed into a rectangular open-topped carton simply by applying pressure inwardly at its ends so that the composite end panels and the base panel unfold about their respective medial fold lines to a flat condition, the flap members connected to these end panels becoming separated from one another and folding down onto the upper, or inside, face of the base panel of the carton.

It will be appreciated that the end panel members may be secured together to form the composite end panels by means of staples or other fastenings, rather than by gluing, and in the case of a carton constructed from sheet plastic material may be secured together by welding.

Figure 5:
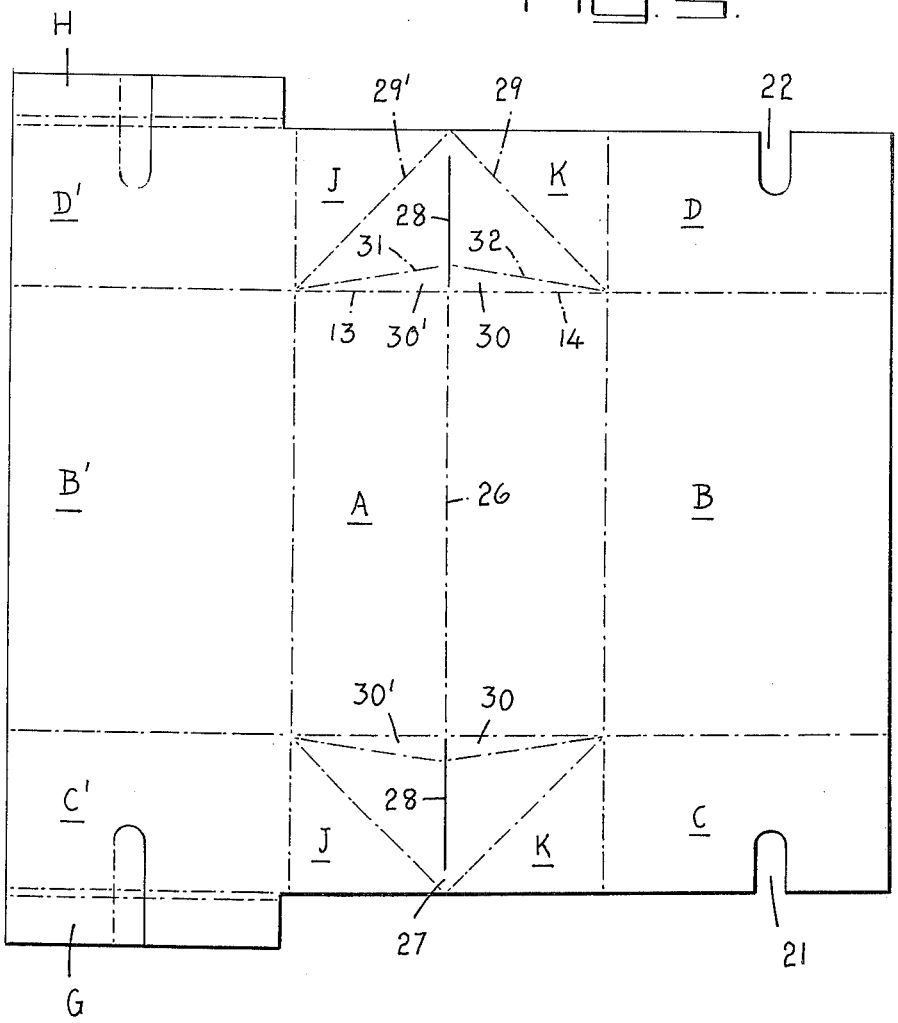
FIG. 5 illustrates a modified blank according to the invention.
Figure 6:
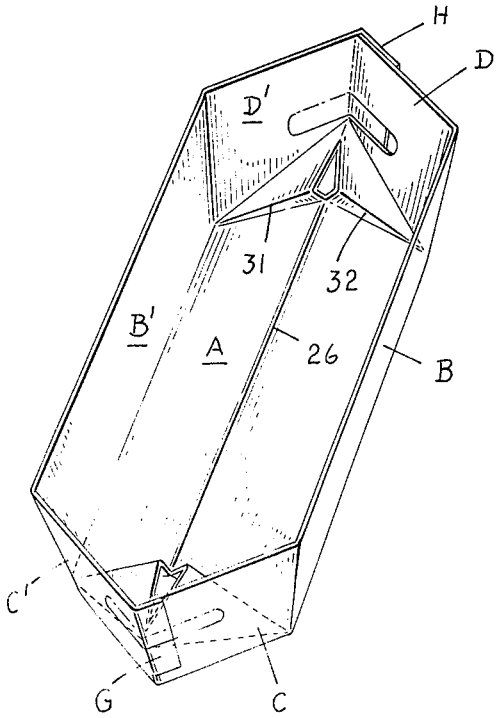
FIG. 6 is a view similar to FIG. 4 but showing a carton constructed from the blank shown in FIG. 5.

The modified blank shown in FIG. 5 is very similar to that of FIG. 1 and the same reference numerals and letters are used to denote corresponding parts. Instead of being hingedly connected to flap members, however, the end panel members C, D, and C′, D′ are interconnected by flap panels J, K, each of which is formed with a partially scored longitudinal medial fold line 27, with a slot 28, and a pair of additional fold lines 29, 29′ which extend diagonally across its respective halves. These fold lines are upwardly expressed so that when the carton is formed, each flap panel forms a folding flap which is folded about the scored line 27 in the collapsed condition of the carton, and is folded about the diagonal lines 29, 29′ in the erect condition of the carton. Each flap panel is also provided with a triangular gusset 30, 30′ at the juncture of the flap panel with the base panel A, the gusset being defined by transverse fold lines 13, 14 and a pair of fold lines 31, 32 in a V formation adjacent the ends of the base panel.

What I claim as my invention is:

1. A collapsible carton comprising a pair of opposite side panels having respective parallel bottom edges and a pair of opposite end panels having respective parallel bottom edges, the side and end panels forming a continuous wall, a base panel extending between and connected to the bottom edges of the side panels, each end panel being formed with an outwardly expressed medial fold line and defining a pair of end panel portions on opposite sides thereof, and the base panel being formed with an upwardly expressed medial fold line, the base panel and the end panels, in the collapsed condition of the carton, being folded about their respective medial fold lines so that the side panels lie superimposed with the folded base panel between them, each end panel being formed with a unitary folding flap hingedly connected to its bottom edge on opposite sides of the medial fold line and hingedly connected to the adjacent end of the base panel on opposite sides of its medial fold line, the carton being capable of being erected by application of pressure to its opposite ends whereby the end panels, base panel and flaps are unfolded about their respective fold lines.

2. A blank for producing a carton having an erect condition and a collapsed condition, the blank comprising a generally rectangular strip formed with a pair of downwardly expressed parallel longitudinal fold lines and a pair of downwardly expressed parallel transverse fold lines, said fold lines intersecting one another to define a rectangular base panel, a pair of opposite side panels contiguous with the base panel, two pairs of end panel members continguous with the respective ends of said side panels, and a pair of opposite flap panels continguous with the end panel members and base panel, one end panel member of each pair having a hingedly connected glue strip or fastening strip for connection to the other end panel member of the pair, the base panel being formed with an upwardly expressed longitudinal medial fold line, and each flap panel being formed with an upwardly expressed longitudinal medial fold line defining a pair of half panels, hingedly interconnected therealong, and a pair of upwardly expressed fold lines extending diagonally across said half panels and intersecting the longitudinal medial fold line at the end of the strip.

3. A collapsible carton as claimed in claim 1, wherein each unitary folding flap consists of an isosceles triangular flap portion and a pair of right triangular flap portions integrally connected thereto along respective folded edges, the isosceles triangular flap portion having a base which is common to the respective end of the base panel, and a pair of equal sides, each right triangular flap portion having a hypotenuse which is common to a respective one of said equal sides, a side which is common to the bottom edge of a respective one of said end panel portions, and a side defining a free edge which is coplanar with said medial fold lines of the base panel and the end panels, and the isosceles triangular flap portion having a medial fold line extending normally to its base.

4. A collapsible carton as claimed in claim 3, wherein the isosceles triangular flap portion is formed with a slot extending along its medial fold line and terminating short of the ends thereof.

5. A collapsible carton as claimed in claim 4, wherein each isosceles triangular flap portion is formed with a triangular gusset defined by the base thereof and a pair of additional fold lines intersecting at the medial fold line of said isosceles triangular flap portion.

6. A blank as claimed in claim 2, wherein each of the flap panels is formed with a slot extending along its medial fold line and terminating short of the ends thereof.

7. A blank as claimed in claim 6, wherein each of the flap panels is formed with a triangular gusset contiguous with a respective end of the base panel and bounded by a pair of downwardly expressed, converging fold lines intersecting at the medial fold line of the flap panel.

* * * * *